US011181273B2

(12) United States Patent
Miduturi et al.

(10) Patent No.: US 11,181,273 B2
(45) Date of Patent: Nov. 23, 2021

(54) FUEL OIL AXIAL STAGE COMBUSTION FOR IMPROVED TURBINE COMBUSTOR PERFORMANCE

(71) Applicant: Siemens Aktiengesellschaft, Munich (DE)

(72) Inventors: Krishna C. Miduturi, Oviedo, FL (US); Stephen A. Ramier, Fredericton (CA); Walter Ray Laster, Oviedo, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 300 days.

(21) Appl. No.: 16/317,715

(22) PCT Filed: Sep. 27, 2016

(86) PCT No.: PCT/US2016/053912
§ 371 (c)(1),
(2) Date: Jan. 14, 2019

(87) PCT Pub. No.: WO2018/063151
PCT Pub. Date: Apr. 5, 2018

(65) Prior Publication Data

US 2019/0309952 A1 Oct. 10, 2019

(51) Int. Cl.
*F23R 3/34* (2006.01)

(52) U.S. Cl.
CPC ..... *F23R 3/346* (2013.01); *F23R 3/34* (2013.01)

(58) Field of Classification Search
CPC .... F23R 3/04; F23R 3/045; F23R 3/34; F23R 3/346; F01D 9/023
See application file for complete search history.

(56) References Cited

U.S. PATENT DOCUMENTS 4,192,138 A * 3/1980 Szema ..... F23R 3/045 431/351
4,193,260 A 3/1980 Carlisle et al.
4,215,537 A * 8/1980 Hurley ..... F02K 1/825 60/264
4,590,769 A * 5/1986 Lohmann ..... F23R 3/045 60/752
4,690,329 A * 9/1987 Madden ..... F02K 1/62 239/265.19
4,887,432 A * 12/1989 Mumford ..... F23R 3/06 60/759
5,350,293 A 9/1994 Khinkis et al.
(Continued)

OTHER PUBLICATIONS

PCT International Search Report and Written Opinion of International Searching Authority dated May 29, 2017 corresponding to PCT International Application No. PCT/US2016/053912 filed Sep. 27, 2016.

*Primary Examiner* — William H Rodriguez

(57) ABSTRACT

A turbine engine has two combustion zones so as to operate in conditions where water scarcity is an issue. The secondary combustion zone is located downstream of the primary combustion zone. Fuel can be fed into an air scoop having air from a shell surrounding the primary and secondary combustion zone. The feeding of the fuel through the air scoop allows atomization of the fuel. The mixture can then enter the secondary combustion zone and mix with the products from the first combustion zone.

19 Claims, 2 Drawing Sheets

(56) References Cited

U.S. PATENT DOCUMENTS

| | | | | |
|---|---|---|---|---|
| 6,351,949 | B1 * | 3/2002 | Rice | F23R 3/007 403/316 |
| 8,863,523 | B2 * | 10/2014 | Chen | F23R 3/002 60/733 |
| 8,904,796 | B2 * | 12/2014 | Singh | F23R 3/045 60/733 |
| 8,991,192 | B2 * | 3/2015 | Wiebe | F23R 3/46 60/800 |
| 2007/0271901 | A1 * | 11/2007 | Gustafsson | F02K 1/28 60/230 |
| 2008/0016873 | A1 * | 1/2008 | Harefors | F02K 1/002 60/770 |
| 2011/0056206 | A1 | 3/2011 | Wiebe | |
| 2011/0289928 | A1 * | 12/2011 | Fox | F23R 3/286 60/740 |
| 2013/0008178 | A1 * | 1/2013 | LeBegue | F02C 3/14 60/796 |
| 2013/0031908 | A1 | 2/2013 | DiCintio et al. | |
| 2013/0174558 | A1 * | 7/2013 | Stryapunin | F23R 3/002 60/734 |
| 2013/0232980 | A1 | 9/2013 | Chen et al. | |
| 2014/0182294 | A1 | 7/2014 | Matsumoto et al. | |
| 2014/0196465 | A1 | 7/2014 | Laster et al. | |
| 2015/0276226 | A1 * | 10/2015 | Laster | F23R 3/06 60/731 |
| 2016/0258629 | A1 * | 9/2016 | Slobodyanskiy | F23R 3/346 |
| 2017/0059159 | A1 * | 3/2017 | Varney | C04B 41/81 |
| 2018/0187893 | A1 * | 7/2018 | DiCintio | F23R 3/002 |
| 2019/0086092 | A1 * | 3/2019 | Boardman | F23R 3/18 |
| 2019/0178497 | A1 * | 6/2019 | Jones | F23R 3/002 |
| 2019/0226680 | A1 * | 7/2019 | North | F23R 3/286 |
| 2019/0301738 | A1 * | 10/2019 | North | F23R 3/002 |
| 2020/0041127 | A1 * | 2/2020 | Vukanti | F23R 3/06 |

* cited by examiner

FUEL OIL AXIAL STAGE COMBUSTION FOR IMPROVED TURBINE COMBUSTOR PERFORMANCE

BACKGROUND

1. Field

Disclosed embodiments are generally related to turbine engines and, more particularly to multistage fuel injection.

2. Description of the Related Art

A turbine engine typically has a compressor section, a combustion section having a number of combustors and a turbine section. Ambient air is compressed in the compressor section and conveyed to the combustors in the combustion section. The combustors combine the compressed air with a fuel and ignite the mixture creating combustion products. The combustion products flow in a turbulent manner and at a high velocity. The combustion products are routed to the turbine section via transition ducts. Within the turbine section are rows of vane assemblies. Rotating blade assemblies are coupled to a turbine rotor. As the combustion product expands through the turbine section, the combustion product causes the blade assemblies and turbine rotor to rotate. The turbine rotor may be linked to an electric generator and used to generate electricity.

A fuel injection system is employed to introduce fuel into each combustor. The combustion that occurs can result in the formation of oxides of nitrogen (NOx) which is not desirable.

Water can be employed in the fuel injection system in order to reduce the production of NOx. Water injection is also employed in order to prevent flashback. However, the implementation of water can prove problematic where water costs are an issue.

SUMMARY

Briefly described, aspects of the present disclosure relate to fuel injection zones.

An aspect of the disclosure may be a combustion system for a turbine engine. The combustion system may have a primary fuel injection system for injecting a fuel; a combustion basket located downstream of the primary fuel injection system, wherein the primary fuel injection system injects the fuel into the combustion basket creating a primary combustion zone; a transition system located downstream of the primary combustion zone, wherein a portion of the transition system surrounds the combustion basket; and a secondary fuel injection system located downstream of the primary fuel injection system, wherein the secondary fuel injection system comprises an air scoop; wherein the secondary fuel injection system injects the fuel downstream from where the primary fuel injection system injected the fuel and upstream of an exit from the transition system, wherein the injection of the fuel by the secondary fuel injection system creates a secondary combustion zone, wherein the fuel is not mixed with water Another aspect of the disclosure may be a method for operating a turbine engine. The method may comprise injecting a fuel via a primary fuel injection system into a combustion basket creating a primary combustion zone, injecting the fuel via a secondary fuel injection system located downstream of the primary fuel injection system and upstream of an exit of a transition system thereby creating a secondary combustion zone, wherein the secondary fuel injection system comprises an air scoop; wherein the fuel is not mixed with water.

Still yet another aspect of the disclosure may be a turbine engine. A primary fuel injection system for injecting a fuel; a combustion basket located downstream of the primary fuel injection system, wherein the primary fuel injection system injects the fuel into the combustion basket creating a primary combustion zone; a transition system located downstream of the primary combustion zone, wherein a portion of the transition system surrounds the combustion basket; and a secondary fuel injection system located downstream of the primary fuel injection system, wherein the secondary fuel injection system comprises an air scoop; wherein the secondary fuel injection system injects the fuel downstream from where the primary fuel injection system injected the fuel and upstream of an exit from the transition system, wherein the injection of the fuel by the secondary fuel injection system creates a secondary combustion zone, wherein the fuel is not mixed with water.

DETAILED DESCRIPTION

The present inventors have recognized certain drawbacks that affect at least some existing turbine engines. Some turbine engines require water in order to operate when using oil fuel. The water and fuel oil are mixed prior to injection into the combustor. The water is used to prevent flash back and reduce NOx emissions. However in some areas of the world water is an expensive commodity. Therefore being able to reduce the water usage of a turbine engine can make the turbine engine more cost effective in these areas.

In view of these recognitions, the present inventors propose an innovative turbine engine that is able to operate with reduced amounts of water or no water, while still preventing flash back and reducing NOx emissions. Without limitation, disclosed embodiments of the turbine engine may be made that inject fuel into a secondary location downstream of the primary location. This permits reduction of the flame temperature of the primary combustion zone. Reduction of the flame temperature of the primary combustion zone helps reduce the incidence of flashback. Additionally the lower flame temperature reduces the production of NOx. Furthermore, the injection of fuel into at secondary downstream location results in lower residence times of the fuel within the system, which also reduces the production of NOx.

It should be understood that additional benefits may be achieved by the features disclosed herein and are not limited to those discussed above.

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Figure 1:
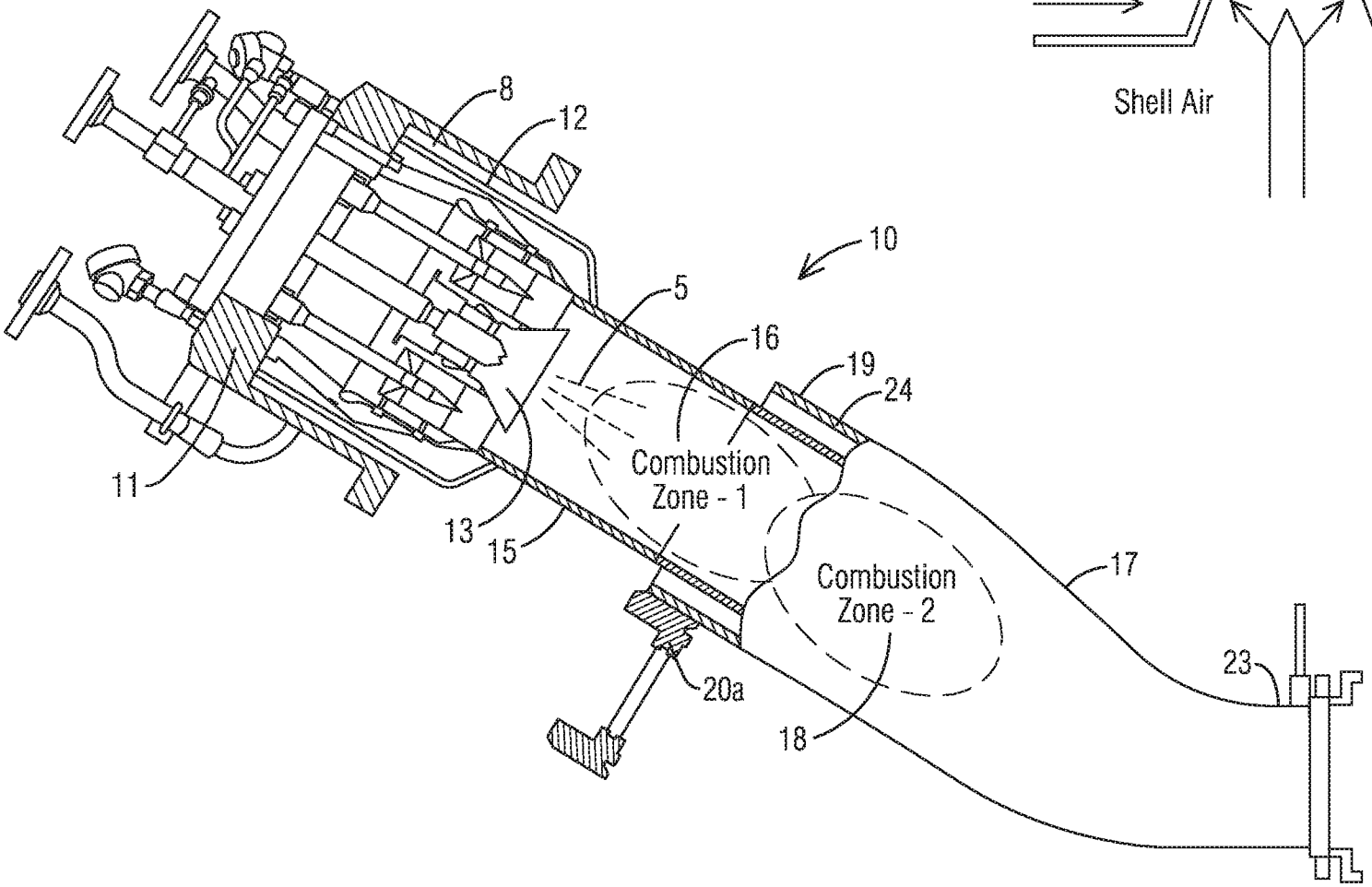
FIG. 1 is a cutaway view of a combustion system assembly.

FIG. 1 is a cutaway view of the combustion system 10. Shown is the primary fuel injection system 8 supported within the support housing 11. The primary fuel injection system 8 has a plurality of pilot nozzles 9 that inject a fuel 5 into a combustion basket 15 via a pilot cone 13. The fuel 5 may be a fuel oil or other combustion product. The fuel 5 is then ignited resulting in the primary combustion zone 16. Hot working gases are produced in the primary combustion zone 16 within the combustion basket 15. These hot working gases flow downstream through the combustion system 10 towards the transition system 17.

Surrounding the combustion basket 15 and the transition system 17 is a shell 19. The shell 19 shields the combustion basket 15 and the transition system 17 from environmental factors and also permits air to flow through the shell 19 to cool the combustion basket 15 and the transition system 17.

Located within the shell 19 is an air scoop 20*a* and injector 22. While reference is made to an air scoop 20*a*, it should be understood that other air scoops discussed herein may be used in the combustion system 10 and the combustion system 10 is not limited to the air scoop referred to herein. These alternative air scoop embodiments are discussed further below.

The secondary fuel injection system 22 injects the fuel 5 at a location that is downstream of the primary combustion zone 16. The fuel 5 mixes with air that is fed by the air scoop 20*a* from the shell 19. This permits atomization of the fuel 5 while the air is still at the temperature of the air within the shell 19. The atomized fuel 5 then enters into the secondary combustion zone 18 where it is mixed with the hot working gases flowing from the primary combustion zone 16. The secondary combustion zone 18 may be within the transition system 17 located downstream from the combustion basket 15.

The injection of the fuel 5 at the location further downstream of the primary combustion zone 16 permits the flame temperature in the primary combustion zone 16 to be lower. Having the flame temperature in the primary combustion zone 16 be lower reduces incidences of flashback. The reduction of the incidences of flashback means that the need for water is reduced because it is not needed to reduce flashback. The lower flame temperature further reduces the production of thermal NOx. This in turn further permits the reduction in the use of water since it is not needed to mitigate the production of NOx. Having the fuel injected further downstream further prevents coking by lowering residence times for the fuel and reducing the overall temperatures.

Figure 2:
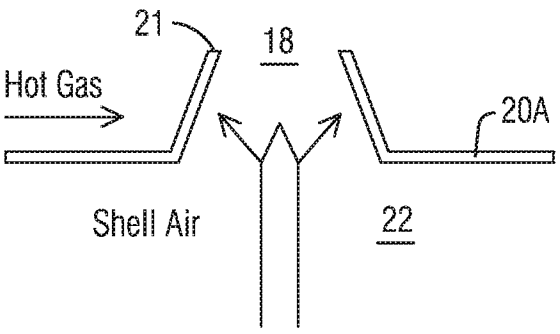
FIG. 2 is a schematic view of injection of the secondary fuel into the combustion system.

FIG. 2 is a schematic view of injection of the fuel 5 into the combustion system 10 and the secondary combustion zone 18. Air from within the shell 19 is delivered via air scoops 20*a* and mixes with the fuel 5 injected from the secondary fuel injector 22. The mixing of the fuel 5 with the air delivered via the air scoop 20*a* results in atomization of the fuel 5. The type of air scoop used and the number of air scoops can control the atomization of the fuel 5 and ultimately affect the interaction of the fuel 5 with the hot working gases from the primary combustion zone 16. This is discussed further below. Atomized fuel 5 is injected via fuel inlets 21 into the secondary combustion zone 18. In FIG. 1, the secondary combustion zone 18 is formed in the area between the combustion basket 15 and the transition system 17.

It should be understood that the secondary combustion zone 18 may be formed at any location downstream of the primary combustion zone 16. So for instance the secondary combustion zone 18 may be located in the combustion basket 15 along with the primary combustion zone 16. As another example, the secondary combustion zone 18 may be fully within the transition system 17. The location of the secondary combustion zone 18 is controlled by various factors impacting the atomization and temperature levels of the hot working gases within the secondary combustion zone 18. The preferred combination of factors has the secondary combustion zone 18 located at a position downstream of the primary combustion zone 16 but not so far downstream that it is located at the exit 23 of the transition system 17. If the secondary combustion zone 18 is located too close to the primary combustion zone 16, then it has the same effect as having no secondary combustion zone 18. If the secondary combustion zone 18 is located too close to the exit 23 of the transition system 17 there will not be sufficient time for combustion. For example, the secondary combustion zone 18 may be located downstream of the primary combustion zone 16 at a location proximate to where the transition system 17 surrounds the combustion basket 15. Having the secondary combustion zone 18 located in the surrounding region 24 can assist in minimizing the need for water and still being able to achieve low NOx emissions.

Indeed, a preferred combination of factors results in minimizing or avoiding the need for water to be used within the combustion system assembly. Avoiding the need for water reduces the costs associated in operating the combustion system assemblies. As discussed above, obtaining the reduction of water is achieved by permitting the flame temperature that occurs in the primary combustion zone 16 to be low enough that it can operate without flashback or the production of too much NOx.

Still referring to FIG. 2, the fuel 5 is shown being injected orthogonally with respect to the flow of the working gases as they move downstream. While the fuel inlet 21 is shown having the fuel 5 injected at a 90 degree angle, other angles are possible for the injection of the fuel 5. For example the fuel 5 may be injected at any angle between 0 to 90 degrees with respect to a primary flow direction of the working gases within the combustion basket 15 and of the combustion system 10 in general. The angle at which the fuel 5 is injected into the combustion system 10 impacts the combustion that occurs within the secondary combustion zone 18.

Figure 3:
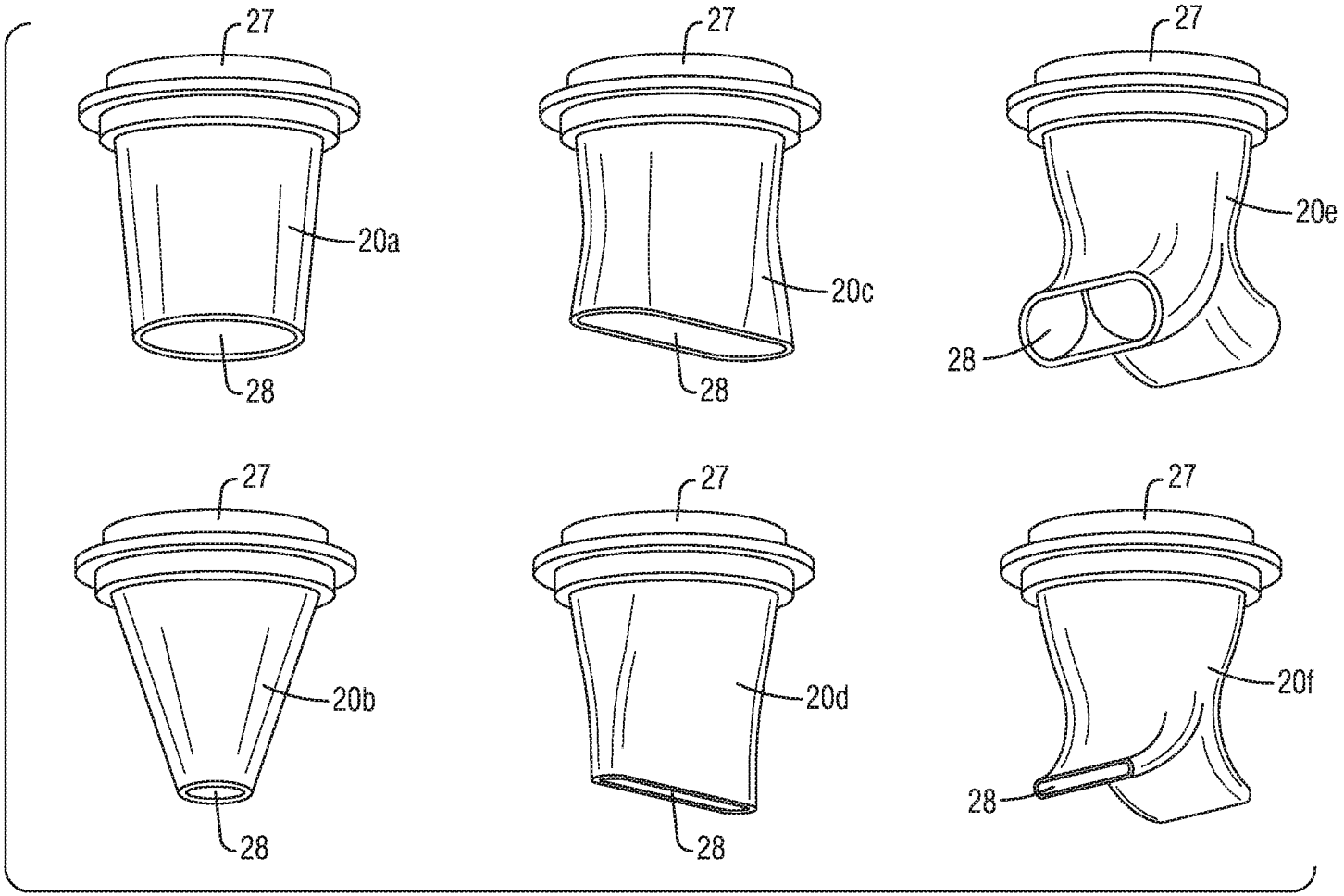
FIG. 3 is a view of air scoops.

FIG. 3 is a view of various geometries that may be employed for the air scoops. These are shown by air scoops 20*a*-20*f*. Each of air scoops 20*a*-20*f* will be discussed below. Each of the geometries of air scoops 20*a*-20*f* may be located within the shell 19 and can be used to feed air into the secondary combustion zone 18. The number, placement and geometry of the air scoops can impact the temperature and effectiveness of the secondary combustion zone.

Air scoop 20*a* is a conical air scoop that narrows gradually (as compared to air scoop 20*b* below). The inlet 27 of the air scoop 20*a* has a larger diameter than the outlet 28 of the air scoop 20*a*.

The air scoop 20*b* is similar to the air scoop 20*a* in that it is also conical in shape. However with air scoop 20*b* the outlet 28 is has a much smaller diameter than the inlet 27. Having the diameter of the outlet 28 be much smaller than the diameter of the inlet 27 causes the flow of air through the air scoop 20*b*. Higher velocities enhance atomization of fuel oil into finer droplets. The velocity of the flow of air may be tuned in order to provide an optimal balance between emissions and preventing flashback.

Air scoop 20*c* and air scoop 20*d* both have circular inlets 27 and rectangular shaped outlets 28. Scoop 20*c* has a larger outlet 28 than the air scoop 20*d*. The geometries of air scoop 20*c* and air scoop 20*d* impact the flow of air that mixes with the secondary fuel 6. The flow of air impacts the atomization of the secondary fuel 6 and how the secondary fuel 6 impacts the secondary combustion zone.

Air scoop 20*e* and air scoop 20*f* have similar geometries. Both have circular inlets 27. The scoop 20*e* has two outlets 28 and the air scoop 20*f* has two outlets 28. Each of the two outlets 28 are rectangular shaped. Furthermore, the two outlets expel air in opposite directions. This impacts the flow of air that atomizes the secondary fuel 6 and can further impact the combustion that occurs in the secondary combustion zone 18. Air scoops 20*e* and 20*f* provide better mixing through improved circumferential penetration.

The air scoops 20*a*-20*f* and combustor system 10 discussed herein permit operation with little to no water. Having the secondary combustor zone 18 downstream of the primary combustion zone 16 provides better control of the flame temperate and operation without water.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A combustion system for a turbine engine comprising:

a primary fuel injection system for injecting a fuel;

a combustion basket located downstream of the primary fuel injection system, wherein the primary fuel injection system injects the fuel into the combustion basket creating a primary combustion zone;

a transition system located downstream of the primary combustion zone, wherein a portion of the transition system surrounds the combustion basket;

a secondary fuel injection system located downstream of the primary fuel injection system, wherein the secondary fuel injection system comprises an air scoop; wherein the secondary fuel injection system injects the fuel downstream from where the primary fuel injection system injected the fuel and upstream of an exit from the transition system, wherein the injection of the fuel by the secondary fuel injection system creates a secondary combustion zone, wherein the fuel is not mixed with water, and a shell surrounding at least a portion of the combustion basket and at least a portion of the transition system that allows air to flow through, whereon the air scoop is located within the shell and configured to mix the fuel injected by the secondary fuel injection system with the air delivered from the shell and inject the mixture into the secondary combustion zone.

2. The combustion system of claim 1, wherein the secondary combustion zone is located at a location where the transition system surrounds the combustion basket.

3. The combustion system of claim 1, wherein the secondary fuel injection system injects the fuel at an angle greater than 45 degrees with respect to a primary flow direction within the combustion basket.

4. The combustion system of claim 1, wherein the secondary fuel injection system injects the fuel at an angle less than 90 degrees with respect to a primary flow direction within the combustion basket.

5. The combustion system of claim 1, wherein the secondary fuel injection system injects the fuel at a 90 degree angle with respect to a primary flow direction within the combustion basket.

6. The combustion system of claim 1, wherein the secondary fuel injection system comprises a plurality of air scoops.

7. The combustion system of claim 1, wherein the air scoop is conical shaped.

8. The combustion system of claim 1, wherein the air scoop has one inlet and two outlets.

9. The gas turbine engine of claim 1, wherein the secondary fuel injection system comprises a plurality of air scoops.

10. The turbine engine of claim 1, wherein the secondary combustion zone is located at a location where the transition system surrounds the combustion basket.

11. A method for operating a turbine engine comprising:

injecting a fuel via a primary fuel injection system into a combustion basket creating a primary combustion zone, and injecting the fuel via a secondary fuel injection system located downstream of the primary fuel injection system and upstream of an exit of a transition system thereby creating a secondary combustion zone, wherein the secondary fuel injection system comprises an air scoop; wherein the fuel is not mixed with water, wherein a shell surrounds at least a portion of the combustion basket and at least a portion of the transition system that allows air to flow through, and whereon the air scoop is located within the shell and configured to mix the fuel injected by the secondary fuel injection system with the air delivered from the shell and inject the mixture into the secondary combustion zone.

12. The method of claim 11, wherein the secondary combustion zone is located where the transition system surrounds the combustion basket.

13. The method of claim 11, wherein the secondary fuel injection system injects the fuel at an angle greater than 45 degrees with respect to a primary flow direction within the combustion basket.

14. The method of claim 11, wherein the secondary fuel injection system injects the fuel at an angle less than 90 degrees with respect to a primary flow direction within the combustion basket.

15. The method of claim 11, wherein the secondary fuel injection system injects the fuel at a 90 degree angle with respect to a primary flow direction within the combustion basket.

16. The method of claim 11, wherein the secondary fuel injection system comprises a plurality of air scoops.

17. The method of claim 11, wherein the air scoop is conical shaped.

18. The method of claim 11, wherein the air scoop has one inlet and two outlets.

19. A turbine engine comprising:

a primary fuel injection system for injecting a fuel;

a combustion basket located downstream of the primary fuel injection system, wherein the primary fuel injection system injects the fuel into the combustion basket creating a primary combustion zone;

a transition system located downstream of the primary combustion zone, wherein a portion of the transition system surrounds the combustion basket;

a secondary fuel injection system located downstream of the primary fuel injection system, wherein the secondary fuel injection system comprises an air scoop; wherein the secondary fuel injection system injects the fuel downstream from where the primary fuel injection system injected the fuel and upstream of an exit from the transition system, wherein the injection of the fuel by the secondary fuel injection system creates a secondary combustion zone, wherein the fuel is not mixed with water, and a shell surrounding at least a portion of the combustion basket and at least a portion of the transition system that allows air to flow through, whereon the air scoop is located within the shell and configured to mix the fuel injected by the secondary fuel injection system with the air delivered from the shell and inject the mixture into the secondary combustion zone.

* * * * *